US005152092A

United States Patent [19]

O'Brien

[11] Patent Number: 5,152,092

[45] Date of Patent: Oct. 6, 1992

[54] TRAFFIC SAFETY DEVICE

[76] Inventor: James B. O'Brien, 33 Adelphia Dr., Jackson, N.J. 08527

[21] Appl. No.: 866,486

[22] Filed: Apr. 10, 1992

Related U.S. Application Data

[63] Continuation-in-part of Ser. No. 601,079, Oct. 23, 1990, abandoned, which is a continuation-in-part of Ser. No. 351,400, May 15, 1989, abandoned.

[51] Int. Cl.[5] ..... G09F 15/00

[52] U.S. Cl. ..... 40/610; 40/612; 446/220

[58] Field of Search ..... 40/212, 214, 217, 538, 40/539, 582, 606, 610, 612; 206/69, 216; 116/63 P, 210, DIG. 8; 446/220

[56] References Cited

U.S. PATENT DOCUMENTS

| | | | |
|---|---|---|---|
| 2,641,075 | 6/1953 | Saul | 40/612 |
| 2,762,327 | 9/1956 | Weig | 40/612 X |
| 2,808,803 | 10/1957 | Weig | 40/612 X |
| 3,056,377 | 10/1962 | Nelson | 40/610 X |
| 3,132,624 | 5/1964 | Shoemaker, Jr. | 40/612 X |
| 3,197,628 | 7/1965 | Schuff | 40/612 X |
| 3,934,065 | 1/1976 | Tung | 40/615 X |
| 4,312,600 | 1/1982 | Schaff et al. | 40/612 X |
| 4,978,245 | 12/1990 | White | 116/63 P X |

FOREIGN PATENT DOCUMENTS

| | | | |
|---|---|---|---|
| 483816 | 6/1952 | Canada | 40/612 |
| 737165 | 6/1966 | Canada | 40/612 |
| 2555346 | 5/1985 | France | 40/612 |

*Primary Examiner*—Kenneth J. Dorner
*Assistant Examiner*—Brian K. Green
*Attorney, Agent, or Firm*—Charles I. Brodsky

[57] ABSTRACT

The traffic safety device of the invention incorporates a see-through, vinyl or rubber-type bag, inflatable to a height of some 4–5 feet and to a width to approximate that of a typical lane of traffic. The inside rear surface of the bag is provided with a reflective material to reflect headlight illumination through any one of a number of highway warning signs that may be draped across the outside front surface of the bag. A pair of elastic straps are stretched to encircle the bag as it is inflated, and automatically pull and guide the bag back into a storage box for the device as the bag is deflated and the straps return to their original lengths.

2 Claims, 2 Drawing Sheets

TRAFFIC SAFETY DEVICE

This is a continuation-in-part Application of application Ser. No. 07/601,079 filed Oct. 23, 1990 now abandoned, which is a continuation-in-part application of application Ser. No. 07/351,400, filed May 15, 1989, now abandoned.

FIELD OF THE INVENTION

This invention relates to traffic safety enforcement, and, more particularly, to an easily assemblable warning device which can just as easily be dismantled for storage when not in use.

BACKGROUND OF THE INVENTION

As is well known and appreciated, the most attractive areas of police law enforcement revolve around the prevention of crime and around the apprehension of those engaged in criminal enterprises. As is equally understood, at the other end of the spectrum, the least attractive area of police involvement has been suggested to be that of traffic control. Akin to the drudgery of directing and controlling traffic flow—but of an absolute necessity—is the activity of the law enforcement officer regulating traffic at an accident scene, or when a roadway obstruction exists. The number of instances are legion where police officers must station themselves at opposite ends of a roadway to divert traffic flow because of a disabled vehicle or road disrepair located inbetween. Because of the general shortage of municipal police law enforcement officers, it would be better practice to utilize the police skills in other activities than mere "traffic-diversion" besides effectuating a savings of the salaries governments pay for these mundane types of law enforcements. For such reasons, for example, the use of highway warning signs have become more pronounced.

However, such warning signs as are generally utilized, once placed on the ground, are of a nature as can be easily driven around, and can be blown over by wind conditions. Being constructed of great bulk, therefore, as a necessity to overcome these limitations, such safety warning signs also require illumination for nighttime use,—usually by flickering candle—which must be regularly checked out as to their continued working, otherwise the signs, themselves, may become almost more of a danger than the peril which they are intended to warn against. And, obviously, by virtue of of their being quite bulky and heavy, the problem always arises concerning the ease with which those warning signs can be carried about, set up, and stored when not in use. Even with such limitations, though, the use of such warning, and barrier, devices continue today, and because of the urgent need to be able to regulate traffic in these emergent areas under strident control.

SUMMARY OF THE INVENTION

As will become clear hereinafter, the traffic safety device of the invention can be utilized to free the police officer of the need to be present in controlling traffic at these locations, and to enable the officer to engage in other activities—while, at the same time, continuing to effectuate the desired control required by the situation at hand. In accordance with a preferred embodiment of the invention, the traffic safety device incorporates a see-through, vinyl or rubber-type bag, inflatable to a height of some 4–5 feet and to a width to approximate that of the typical lane of highway traffic. The inside rear surface of the bag, according to this embodiment, is provided with a reflective material to reflect headlight illumination through any one of a number of highway warning signs that may be draped across the outside front surface of the bag (e.g., "Do Not Enter", "Lane Closed", "Road Under Construction", "Accident Ahead", etc.). In operation, a pair of elastic straps are stretched to encircle the bag as it is being inflated, and automatically pull, and guide, the bag back into a storage box for the device as the bag is being deflated and the straps return to their original lengths. A "release" plug is provided for deflating the bag, and a valve is provided for use when it is desired to inflate the bag and set up the warning arrangement. In accordance with the preferred embodiment, the storage box for the device can be provided with a re-chargeable air tank to inflate the bag, with the storage compartment also being sufficiently large to accept the deflated bag as well as to receive appropriate "sand bags", or other weighted material, in maintaining the construction in an upright, active position when set-up in the field by the police officer, in whose patrol vehicle the equipment may be kept.

As will be seen, the preferred embodiment of the invention envisions the use of a heavy-duty plastic construction for the storage box, with a capacity sufficiently large to hold approximately 4–6 "sand bags" of 10 pound weight each, so that the storage box and the individual "sand bags" can be easily carried about by the police officer. Appropriate handles are provided to facilitate this carrying-about of the storage box, and in an alternative embodiment, the re-chargeable tank can be replaced by carbon dioxide canisters to be used in inflating the see-through bag. Also described in a further embodiment—yet, still carrying out the principles of the invention—is an alternative form of inflatable bag, tubular in configuration so as to permit an easy pass-through of wind in increasing the ability of the traffic safety device to withstand inclement conditions, while still being fabricated with a reflective material on an inside, rear surface so as to reflect headlight illumination for nighttime use. As will be appreciated, the incorporation of the reflective surface on the inside of the bag—whatever its final configuration—affords the desirable features of reflecting an increased amount of headlight illumination than would be the situation if the reflective material were on the outside of the unit, and thus available to become dirty, or otherwise covered, during repeated use.

BRIEF DESCRIPTION OF THE DRAWING

These and other features of the invention will be more clearly understood from a consideration of the following description, taken in connection with the accompanying drawing, in which.

DETAILED DESCRIPTION OF THE DRAWING

Figure 1:
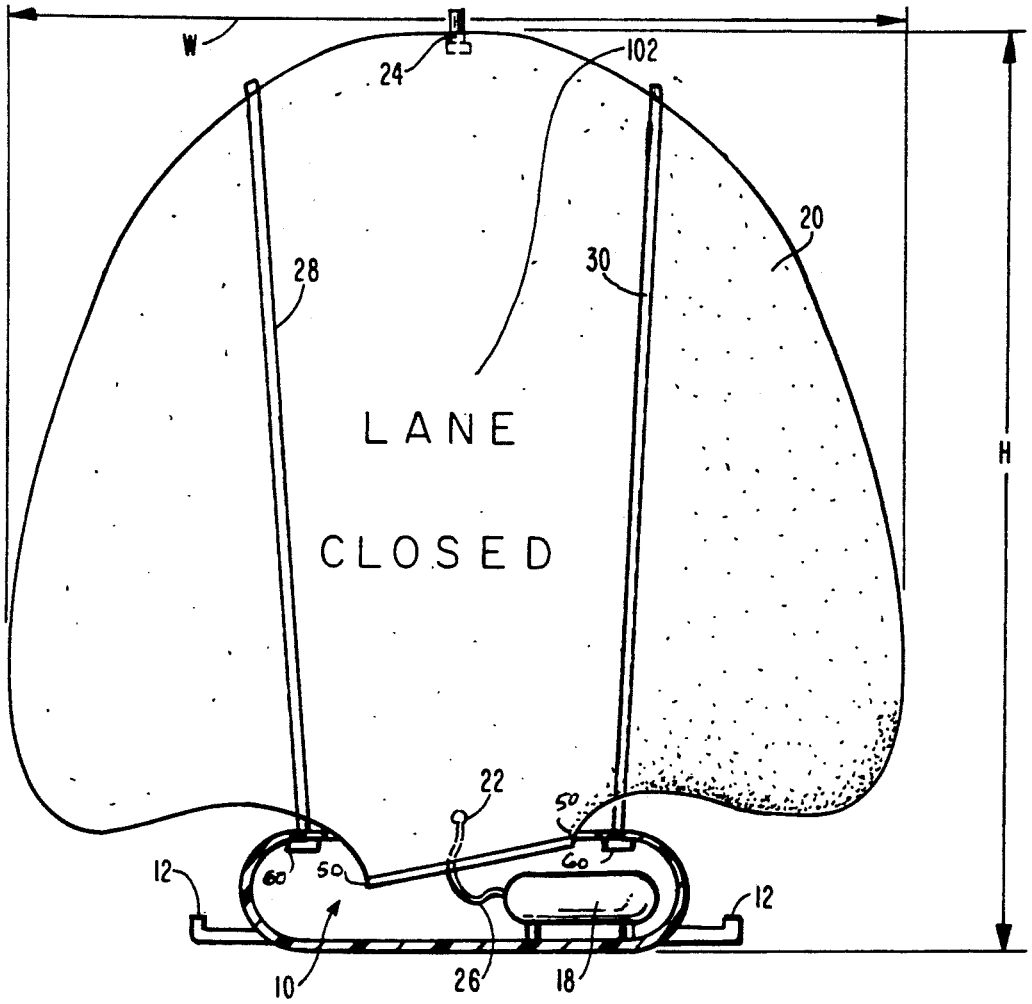
FIG. 1 is a front perspective view illustrating a traffic safety device constructed in accordance with the teachings of the invention, a rear view being essentially identical.
Figure 2:
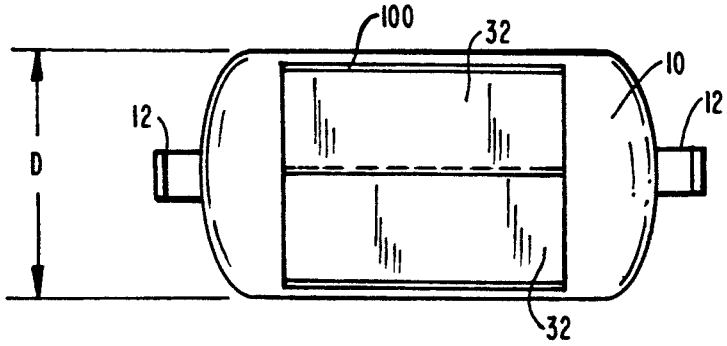
FIGS. 2 and 3 respectively show top and rear views of the traffic safety device of FIG. 1.
Figure 3:
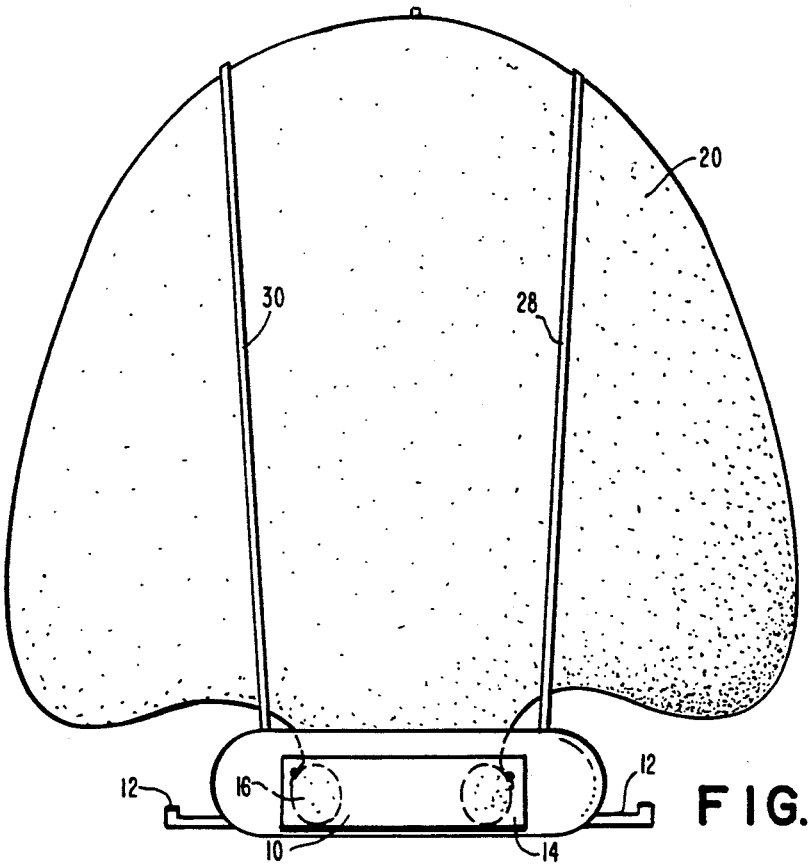

In FIGS. 1-3 the storage box for the traffic safety device is shown by the reference numeral 10, fabricated of heavy duty plastic and with a pair of carry-handles 12. A door 14 is provided in the storage box 10 through which a series of one or more sand bags 16 may be placed to weight the traffic safety device to the ground once it is set up by the police officer. Also located within the storage box 10, and accessible by means of the door 14, is a rechargeable air-tank 18 for use in inflating an air bag 20 of vinyl or rubber-type composition. (As earlier noted, the rechargeable air-tank 18 may be replaced by one or more carbon dioxide canisters, usable as an alternative to the air-tank 18, selected of a capacity to handle upwards of three vinyl or rubber-type bag inflations of the type now to be described.)

In accordance with the invention, the vinyl or rubber-type bag 20 is fabricated so that once filled, would extend to a height H of some 4-5 feet, of a width W of approximately 10 feet (i.e., just short of the width of the typical lane of highway traffic), and of a depth D of some 6"-8". An air valve 22 and a releasable plug 24 are illustrated, the air valve 22 being located adjacent the bottom of the bag 20, so as to be easily connectable to the air tank 18 (or carbon dioxide canister), by means of an appropriate hose 26 connected to the air supply, to inflate the bag. The releasable plug, 24, on the other hand, may be positioned adjacent the top of the bag 20, to be easily released by the police officer once it is decided to deflate the bag and dismantle the traffic safety device and store everything away into the patrol vehicle. The bag 20 will be understood to be secured at an inside of the box 10, at 50, in any desired manner.

In accordance with a specific construction, the embodiment of the invention shown in FIGS. 1-3 is also provided with a pair of elastic straps 28, 30 which surround the bag 20, top to bottom and front to back, and which are secured inside the storage box 10, as at 60. Such straps 28,30 encircle the bag 20, so as to stretch and lengthen as the bag 20 is inflated by the air supply—restraining, however, the inflated bag in position through their securements to the inside of the box 10, at 60. Correspondingly, the tension which such stretching creates as the bag is being filled—because of the elastic nature of the straps 28, 30—operates to pull the bag 20, and guide it, back into the box 10, once the plug 20 is released and the air escapes to deflate the bag, allowing the straps 28, 30 to return to their original lengths.

Access to the storage box 10 is by means of a pair of top doors 32 in the box 10, through which the vinyl or rubber-type bag 20 extends when it is desired to inflate the bag in placing it into use—and through which the elastic straps 28,30 pull, and guide, the deflating bag 20 back into the box 10 when it is desired to store the traffic safety device away. Although the use of such "stretchable" straps facilitates the dismantling of the traffic safety device, it will be appreciated that "non-stretchable" strap arrangements can be employed as an alternative—the use of either adding the feature of stability to the construction once set up, both as regards the front of the erected arrangement, as well as at its rear.

With the dimensions so defined, it will be readily apparent to those skilled in the art how the traffic safety device of the invention can serve as a blockage to traffic flow, as well as serving as a background to which appropriate highway warning signs can be placed, or draped. Motorists can thus be advised of an impending traffic condition, without the need of a police officer present, and in a construction which is stable enough to withstand whatever wind conditions may be present simply by adding additional weight into the storage box 10.

However, and in accordance with an important feature of the invention, the inside of the vinyl or rubber-type bag 20 is provided with a reflective surface so as to reflect headlight illumination for nighttime use. With such arrangement, the highway-signings are constructed of a "stencilled" nature, to permit the passage of the headlight illumination therethrough, only to be reflected back by the reflective surface within the inflated bag. In such manner, any one of a number of highway warning signs may be draped across the front of the bag—though in alternative constructions, one might prefer to arrange the inflatable bag to be provided with the sign warning inside the bag itself, constructed of the reflective type material—although the usefulness of such a version depends upon the ability of the "reflective sign" to maintain its integrity over repeated inflations and deflations, and subsequent storings into the box 10. Analysis has indicated that the preferred way of addressing this situation is as described, with just a reflective material inside of the bag, and with the "stencilled" signs across the front. (In this respect, reflective paint or tape may be incorporated inside the rear surface of the bag 20, so as to reflect back through the clear plastic whatever the illumination shining upon it might be, the reflective paint or tape then being shown as 100 in FIG. 2, and with the stencilled signs being draped across the back of the bag, as at 102.)

Figure 4:
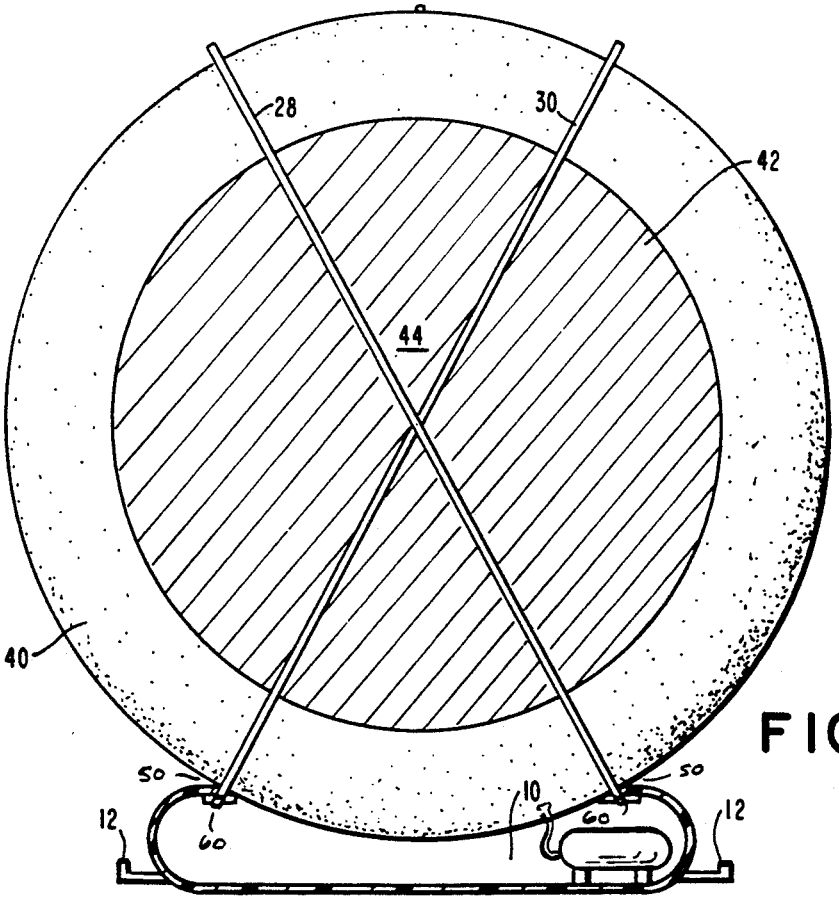
FIG. 4 shows a front perspective view of another embodiment of the invention utilizing an inflatable bag of tubular construction, and with elastic straps encircling the bag.

The embodiment of FIG. 4 has been determined to be particularly useful under high-wind conditions, wherein the inflated bag is fabricated of a tubular configuration 40, with a "mesh-type" reflective composition 42 extending across the opening. Air currents easily pass through the opening 44, but the elastic straps 28, 30 continue to be available to pull, and guide, the bag 40 back into the storage box 10 once the bag is deflated and the straps 28, 30 return to their original length as the tension on them is released, and the traffic safety device can then be stored for later use. Of course—and as with the arrangements of FIGS. 1-3—the police officer can easily then retrieve the individual sand-bags 16 from the storage box 10, to carry them separately to the patrol vehicle, rather than attempting, if it is too heavy, to carry the storage box 10 and all its contents to the police vehicle at the same time. In either event, the storage box 10—as well as the entire traffic safety device of the invention—can easily fit within the trunk of the police vehicle, to be used at a further date. In accordance with the invention, the valve 22 is selected of a size to permit quick inflation of the bag 20 when the warning sign is to be erected, while the plug 24 is selected to a size to allow the bag to quickly deflate for storage. With a rechargeable air tank 18 some 17" long and 4½" wide, and with a releasable plug 24 of 1¾" diameter, the traffic safety device of the invention was noted to inflate to its 4-5 foot height in just 15 seconds, and deflate back into the storage box 10 in less than 5 seconds.

While there have been described what are considered to be preferred embodiments of the present invention, it will be appreciated by those skilled in the art that modifications can be made without departing from the scope of the teachings herein of inflating and deflating an air bag with appropriate "signings" as a traffic safety device in a manner permitting easy storage and a stability when assembled. Different versions of providing "nighttime alerts" have been described, and for at least these and other reasons, resort should be had to the claims appended hereto for a true understanding of the scope of the invention.

I claim:

1. A traffic safety device comprising:

a storage box having a pair of handles for easy carrying-about;

first means providing access for selectively weighting down said box and for removing weight therefrom as desired;

a releasably inflatable bag stored within said box—of a construction to be inflatable to a height of some 4–5 feet, to a width of approximately 10 feet, and to a depth of some 6–8 inches—and with a first end being secured internally of said storage box;

second means for inflating said bag to extend upwardly and outwardly from said storage box, said second means including an air intake valve at a location on said bag adjacent to said first end of said releasably inflatable bag;

third means, connected to said storage box and encircling said inflatable bag, for providing a stabilizing support to said bag as said bag is inflated and for pulling and guiding said bag into said storage box as said bag is deflated;

a release plug at a location on said bag, opposite from said air intake valve, for deflating said inflated bag after use and for actuating said third means to guide said deflated bag into said box for storage; and wherein said third means includes a pair of elastic straps, encircling said bag stretchable to produce a tension thereon as said bag is inflated.

2. The traffic safety device of claim 1 wherein said bag is fabricated of a construction to inflate to a tubular configuration with an opening between facing surfaces of the tubular configuration and wherein there is also included a light reflective mesh attached to said bag extending across said opening.

* * * * *